United States Patent [19]

Puccio

[11] 4,075,728

[45] Feb. 28, 1978

[54] ADJUSTABLE EMBOSSMENT CONNECTOR FOR A COMPOSITE EXPANSION JOINT ASSEMBLY

[75] Inventor: Guy S. Puccio, Lancaster, N.Y.

[73] Assignee: Acme Highway Products Corporation, Buffalo, N.Y.

[21] Appl. No.: 754,129

[22] Filed: Dec. 27, 1976

[51] Int. Cl.[2] ..... E01D 19/06

[52] U.S. Cl. ..... 14/16.5; 404/69; 52/396

[58] Field of Search ..... 14/16.5; 404/69, 68, 404/47, 56; 52/396

[56] References Cited

U.S. PATENT DOCUMENTS

| | | | |
|---|---|---|---|
| 2,013,195 | 9/1935 | Ward | 14/16.5 |
| 3,482,492 | 12/1969 | Bowman | 14/16.5 X |
| 3,604,322 | 9/1971 | Koster | 14/16.5 X |
| 3,732,021 | 5/1973 | Rizza | 14/16.5 X |
| 3,830,583 | 8/1974 | Becht | 404/69 |
| 3,854,159 | 12/1974 | McLean | 14/16.5 |
| 3,904,303 | 9/1975 | Becht | 404/68 |

FOREIGN PATENT DOCUMENTS

| | | | |
|---|---|---|---|
| 1,431,835 | 4/1976 | United Kingdom | 404/69 |

*Primary Examiner*—Nile C. Byers
*Attorney, Agent, or Firm*—Christel & Bean

[57] ABSTRACT

A composite expansion joint assembly of alternating elastic sealing elements and rigid structural members mounted on transversely extending support bars by mounting means restricting vertical and horizontal translational displacement of the structural members. The mounting means comprises two embossments disposed between a structural member and support bar with a pinned connection extending between the embossments so as to allow relative rotational movement between the structural member and support bar. Each support bar has mounted thereon only one structural member with each structural member being supported at each of its ends.

19 Claims, 11 Drawing Figures

ADJUSTABLE EMBOSSMENT CONNECTOR FOR A COMPOSITE EXPANSION JOINT ASSEMBLY

BACKGROUND OF THE INVENTION

This invention relates to expansion joints and, more particularly to composite expansion joints of the type employed in bridge deck constructions for accommodating large movements between adjacent deck sections. Composite expansion joints are conventionally used in those constructions, such as bridge structures and the like, wherein the relative movement between adjacent deck sections in response to temperature changes is too great to be accommodated by a single seal unit. These known composite expansion joints often consist of a series of laterally spaced elastic seals separated by rigid structural members or plates and extend lengthwise of the expansion groove between adjacent bridge deck sections. The rigid structural members or plates are in turn mounted above and on support bars which extend transversely of the expansion groove.

It is known to connect the structural members to support bars in view of the necessity to maintain intimate contact therebetween in view of impact and wheel loads imparted by vehicles passing thereover. When a vehicle traverses over such an expansion joint, the component members thereof are subjected to flexural bending. The rebounding movement due to this bending movement causes the component parts of the espansion joint to impact against one another thereby emitting noises and undergoing considerable "pounding" which deteriorates the joint over a period of time.

Presently, there are two methods by which structural members and support bars are kept in close contact. The first method generally includes the welding of the two components (support bar and structural member) together and providing clustered groups of support bars of multiple units corresponding to the number of structural members so that each structural member is welded to a separate support bar in each cluster and spans those support bars to which it is not welded. Such a structure is provided by designing the support bars to be welded to a structural member at a point one or more inches above the surface of adjacent support bars.

The second method of maintaining surface contact between structural members and support bars is by the use of an uplift restraint assembly which permits a structural member to slide along a support bar while being held in intimate contact therewith so that multiple structural members may be mounted on one support bar.

Although the above prior art structures have been satisfactory in operation, they have not included the flexibility of operation as afforded by the present invention. In designing an expansion joint device, it is desirable to provide for as free a movement of the parts therein as the design will permit and still operate satisfactorily. However, due to such environmental conditions as the sun rising in the east and setting in the west a bridge in many cases receives some sunlight on one side prior to receiving sunlight on the other side. This in turn causes expansion of the bridge to take place on the relatively warmer side at a greater rate than on the relatively cooler side. The resulting differential expansion accordingly causes one side of the expansion joint would be wider at one end (one side of the bridge) than at the other end of the joint (the other side of the bridge). A similar type of movement of the structural members could also take place when for example a braking vehicle passes over an extreme end portion thereof tending to skew the orientation of the structural member with respect to its normmal longitudinal disposition within the expansion groove. With a welded configuration it can be seen that stresses would be introduced at each of the support bar connections because of the skew movement of the structural members. Similar types of stresses would also be developed where the structural members are slideably mounted on the support bars by means of uplift restraints.

SUMMARY OF THE INVENTION

Accordingly, one object of the present invention is to provide a new and improved mounting means for connecting structural members to underlying support bars in a composite expansion joint assembly.

Another object of the present invention is to provide the aforesaid mounting means whereby at least a limited amount of relative rotation is allowed between the structural members and support bars on which they are mounted so as to eliminate stress build-up during skewing movement of the structural members within the expansion groove.

A further object of the present invention is to provide the aforesaid mounting means which allows adjustment in direction of either a support bar or structural member without creating stress in the connection joint therebetween.

Still another object of the present invention is to provide the aforesaid mounting means which facilitates the fabrication of a skewed joint.

In summary, the present invention provides a mounting means operable to connect a structural member longitudinally extending within an expansion groove of a bridge deck assembly to an underlying support bar, the latter extending generally transversely with respect to the expansion groove. The mounting means includes a pair of embossments which are joined together by a pinned connection so that the embossments may rotate relative to one another but are restrained against separation in a direction parallel in the longitudinal axis of the pinned connection and are further restrained against relative translational movement in a plane perpendicular to longitudinal axis of the pinned connection. However, the pinned connection between the embossments allows at least a limited amount of relative rotational movement therebetween. At the point of installation, one embossment is rigidly affixed to the underside of a structural member while the other embossment is rigidly affixed to the upper surface of a support bar. The pinned embossments thereby provide a permanent connection between the structural member and support bar while allowing adjustment in direction of either the support bar or structural member without creating stresses at the point of connection therebetween. The support bar is connected to only one structural member so that the conbined structural member/support bar sub-assembly may freely move in a transverse direction within the expansion groove with respect to the other structural member/support bar sub-assemblies.

The foregoing and other objects, advantages, and characterizing features of the present invention will become clearly apparent from the ensuing detailed description of the following embodiment thereof, taken together with the accompanying drawings wherein like reference characters denote like parts throughout the various views.

DETAILED DESCRIPTION OF A PREFERRED EMBODIMENT

Figure 1:
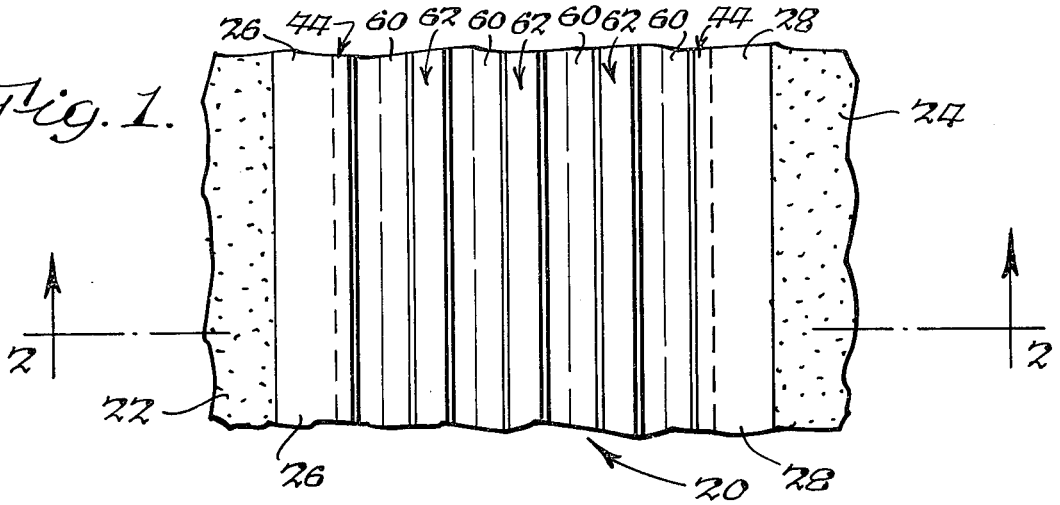
FIG. 1 is a plan view of a composite expansion joint assembly of undertermined length, constructed in accordance with this invention, and shown disposed between a pair of bridge deck sections.

Referring to the illustrative embodiments depicted in the drawings, there is shown in FIG. 1 a composite expansion joint assembly, generally designated 20, constructed in accordance with this invention and shown installed in an expansion groove of substantial width between adjacent bridge deck slabs or sections 22 and 24 formed of reinforced concrete or any other suitable material, which can extend downwardly to the bottom of joint assembly 10, or therebelow, as dictated by the specific construction. Bridge deck section 22 and 24 are provided with edge channels or members 26 and 28 permanently anchored in a conventional manner to the respective deck sections and which have opposed vertical faces 30 and 32 defining the lateral sides of the expansion groove in which expansion joint assembly 20 is installed. Joint assembly 20 extends across the width of the groove between faces 30 and 32 for the full length of the groove transversely to the length of sections 22 and 24.

The lower flanges of edge members 26 and 28 are rigidly secured to the deck sections, and the upper surfaces thereof have mounted thereon a pair of bearing bars or blocks 34. The bearing bars 34 slideably support a support bar 36, which extends transversely across the expansion groove and through specially configurated openings 38 provided in the lower portions of the edge members 26 and 28. As viewed in FIG. 3, the bearing bars 34 extend transversely of the support bars 36 and are provided with slightly arcuately shaped upper bearing surfaces 34a. Bearing bars 34 are secured in a suitable manner to the lower portions of the edge members as shown.

A plurality of support bars 36 (FIGS. 3 and 4) are provided and extend transversely across the expansion groove in a laterally spaced apart relation lengthwise of the groove. Support bars 36 support the anticipated loading on the expansion joint and are of a size and spacing dictated by the particular application as will be more fully discussed hereinbelow.

Each support bar 36 may comprise for example a generally flat-sided solid body which could be provided with a bottom layer of stainless steel to facilitate sliding on bearing bars 34. Such a layer of stainless steel would offer resistence against corrosion to prolong the useful life of the support bar. The support bars are moveable relative to bearing bars 34 during expansion and contraction of the joint upon respective contraction and expansion of bridge deck sections 22 and 24. A pair of projection or stud-like elements 40 and 42 project downwardly from the bottom surface of the support bar adjacent the opposite ends thereof and are engagable with the adjacent side portion of the bearing bars for limiting movement of the support bar in either of its axial directions.

A pair of seal-locking channel members 44 extend lengthwise of the expansion groove and have upper flanges 46 and lower flanges 48. The outer face of channel members 44 are secured to vertical faces 30 and 32 of edge members 26 and 28 respectively, as by means of welding for example.

Figure 2:
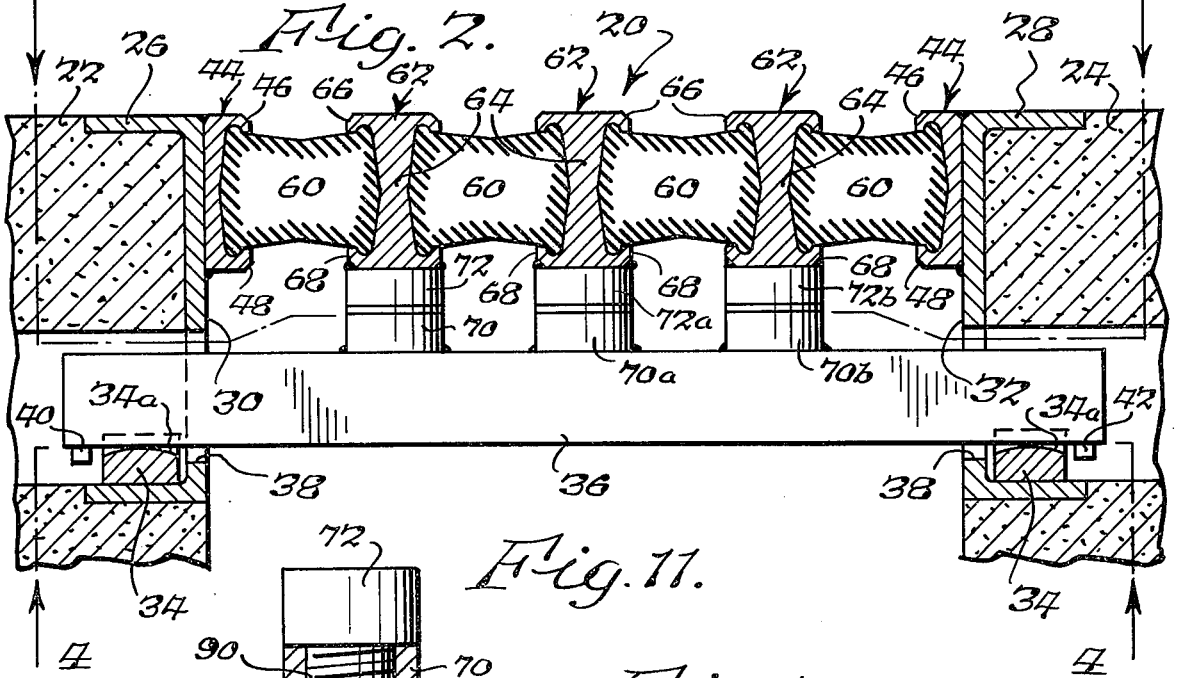
FIG. 2 is a transverse sectional view, on an enlarged scale, taken about on line 2—2 of FIG. 1.

A plurality of resiliently yieldable sealing elements 60 are disposed between seal-locking channel members 44 with the outermost sealing elements 60 received and positioned between flanges 46 and 48 of channel members 44 as shown in FIG. 2. A plurality of I-beam members 62 also are positioned within the space defined by locking channels 44, there being an I-beam 62 interposed between each pair of adjacent seal elements 60. While four such sealing elements 60 are shown in the illustrative embodiment depicted in FIG. 2, it should be understood that more ot less than four sealing elements 60 can be utilized in the expansion joint of this invention, depending on the width of the expansion groove.

Sealing elements 60 comprise tubular members of elastomeric material each having an internal supporting truss structure which can take various configurations, and are secured to channel members 44 and the opposite sides of I-beam members 62 by a suitable adhesive, all in a manner well known in the art. Each I-beam member 62 is provided with a vertical web 64 and upper and lower flanges 66 and 68 extending laterally outwardly from opposite sides of web 64. These flanges 66 and 68 receive and position the intermediate sealing elements 60 in place.

Figure 3:
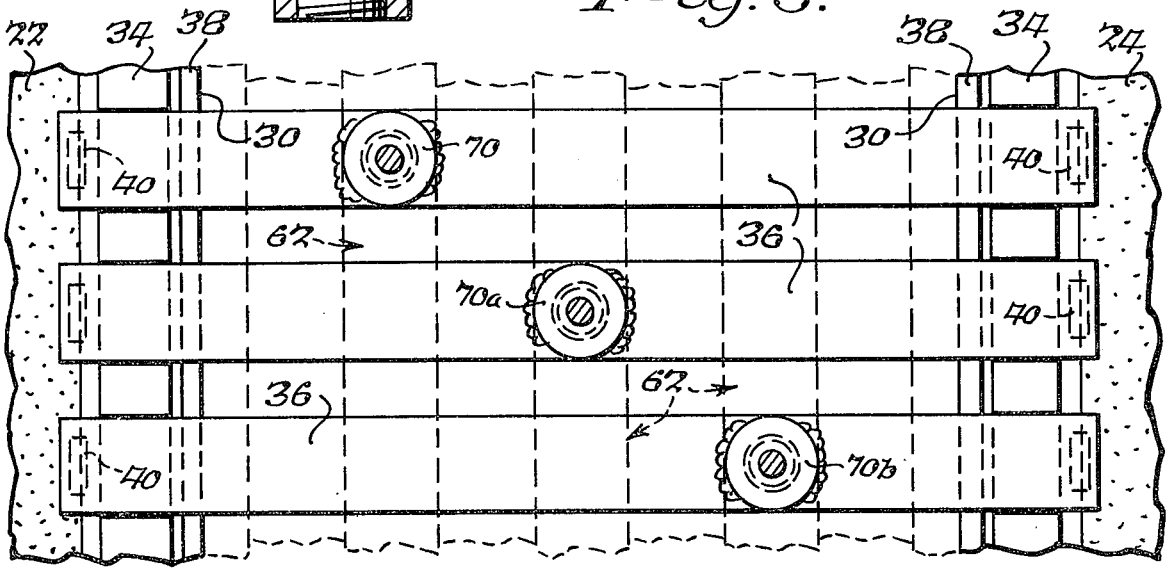
FIG. 3 is a horizontal sectional view, taken about on line 3—3 of FIG. 2.
Figure 4:
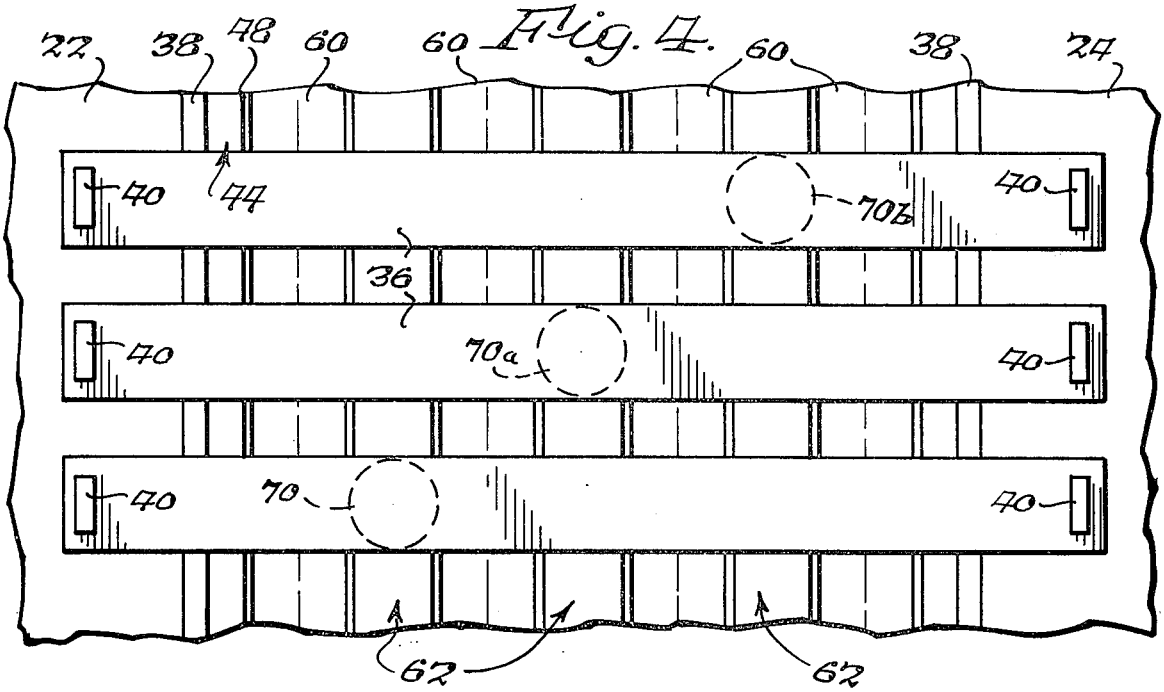
FIG. 4 is a horizontal view, taken on line 4—4 of FIG. 2.

I-beam members 62 are supported on certain respective support bars 36. As shown in FIG. 2, each I-beam or structural member 62 is supported above the support bars by a pair of pinned embossments 70 and 72, 70*a* and 72*a*, and 70*b* and 72*b*. It is to be understood that each support bar 36 is connected to only one structural member by means of the embossment connection means and accordingly, each structural member is connected to and supported by a support bar 36 at a different point along the longitudinal length of the several structural members. In this regard, a comparison of FIGS. 2 and 3 is believed to illustrate the staggered nature of the connection of the structural members to the support bars. Each of the embossments is rigidly affixed to either a structural member or support bar against which is abuts as the case may be. As will be more fully discussed in considering and describing the operation of the present invention, each pair of embossments may undergo relative rotation with respect to one another whereby each structural member 62 may undergo corresponding relative rotation with respect to the support bar 36 to which it is attached. Accordingly, each structural member and attached support bar may freely move transversely within the expansion groove independently of the other support bars and structural members-however, each structural member and connected support bar may not vertically separate from one another or undergo relative translational displacemeent in a horizontal plane as will also be more fully discussed hereinbelow. The present invention is specifically directed to the provision of a pinned connection between a structural member and an underlying support bar to which it is attached thereby providing the above relative rotational type of connection and the associated translational restraint. In this regard, various mounting means including the above embossment pairs, which are pinned together, are provided.

In considering the various embossment embodiments with corresponding connections in FIGS. 5 through 11, each embossment pair will be referred to as 70 and 72. It is to be understood, however, with respect to FIGS. 2 and 3, that the embossments 70*a* and 72*a*, and 70*b* and 72*b* shown therein would be identical, the suffix letters *"a" and "b" used in FIGS. 2 and 3 only indicating the relative positions of the mounting means in an entire joint structure.*

Figure 5:
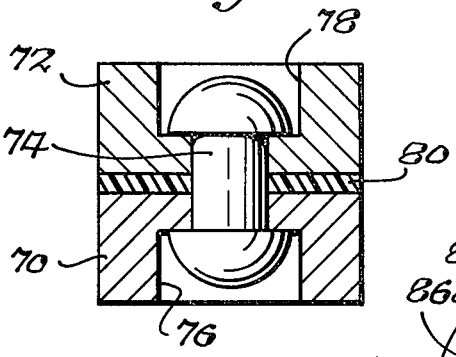
FIG. 5 is an isolated view, partly in section, of one embodiment of the present invention.

FIG. 5 illustrates a pair of embossments joined together by a pin-type element 74 which has each of its ends turned over in a rivet-like manner so as to affirmatively join the embossments one to the other. The ends of pin 74 are received in corresponding cavities 76 and 78 in the embossments, such cavities necessarily communicating with one another by aligned bores in the embossments. As further shown, a resilient shim 80 is provided at the interface of the embossments so as to absorb any looseness in the connection between a structural member and a support bar. Shim 80 could be formed out of urethane material for example. The embodiment shown in FIG. 6 includes an upper embossment 72 having a cavity 78 in which the head of a bolt means 82 is received. The lower embossment 70 has a bore axially aligned with the corresponding bore in embossment 72, both such bores being adapted to receive the threaded portion of bolt 82. Necessarily, the upper surface of the bolt head may include an appropriate female socket so that it may be engaged to firmly retain one embossment to the other.

Figure 7:
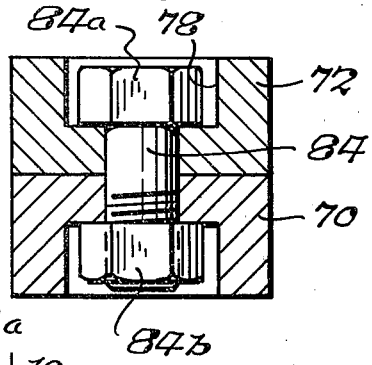
FIG. 7 is partly in section illustrating another embodiment of the present invention.
Figure 6:
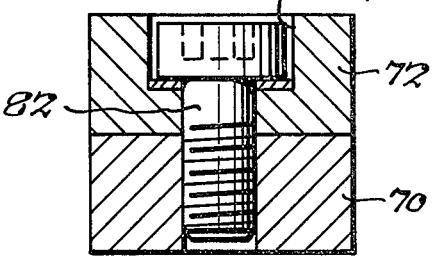
FIG. 6 is a view partly in section showing another embodiment of the present invention.

FIG. 7 illustrates an embossment arrangement quite similar to FIG. 6 wherein a bolt means 84 is provided through aligned bores in embossments 70 and 72 therein. The head 84*a* of the bolt is received in cavity 76 in the embossment 70. Necessarily, bolt 84 may be engaged with nut 84*b* so as to firmly retain the embossments together.

Figure 8:
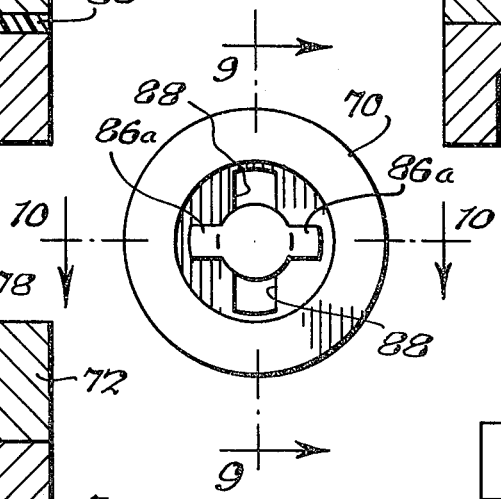
FIG. 8 is a bottom view of yet another embodiment of the present invention.
Figure 9:
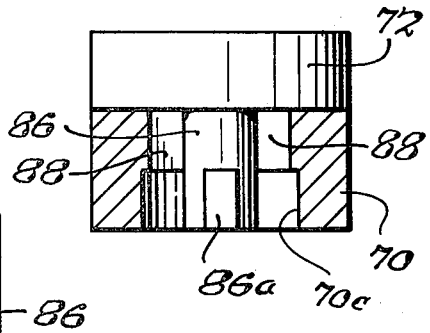
FIG. 9 is an elevational view, partly in section, taken about on line 9—9 of FIG. 8.
Figure 10:
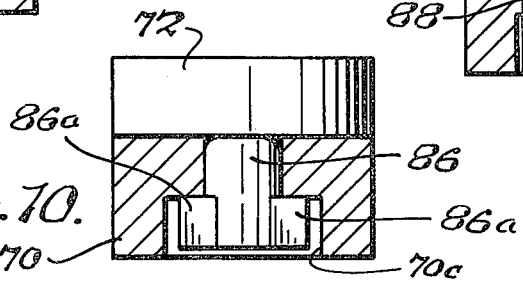
FIG. 10 is a view similar to FIG. 9 taken about on line 10—10 of FIG. 8.

FIG. 8 through 10 illustrate a pair of embossmments maintained together by a stud-type element 86 which extends downwardly from embossment 72 to be received in a keyed slot 88 in embossment 70. Stud 86 includes laterally extending lugs 86*a* which are adapted to be received through slot 88 in embossment 70 as viewed in FIG. 8. After such reception of the lugs 86*a* through slot 88, whereby embossment 72 abuts against the upper surface of embossment 70, the embossments may be rotated 90° with respect to one another so that the locking lugs 86*a* assume the disposition shown in FIG. 8 so that the embossments may not vertically displace with respect to one another but may undergo relative rotation.

Figure 11:
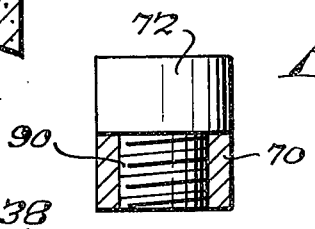
FIG. 11 is a view partly in section showing yet still another embodiment of the present invention.

Another manner of connecting a pair of stacked embossments 70 and 72 one to the other is shown in FIG. 11. In this embodiment, embossment 72 includes a downwardly extending threaded stud member 90 integrally formed therewith and which is received in an appropriately adapted bore in embossment 70 whereby the embossment may not vertically displace with respect to one another but may undergo at least limited rotational movement with respect to one another.

The present invention operates in the following manner when employing any of the mounting means illustrated in FIGS. 5 through 11 or equivalents thereof. The embossment pairs enable the structural members 62 to be rigidly connected to the support bars 36 in a fixed configuration with respect to vertical separation and relative translational movement in a horizontal plane as viewed for example in FIG. 2. However, all of the embossment constructions allow at least some relative rotational movement between the respectively connected structural members and support bars which in effect affords a permanent connection while allowing adjustment and orientation of either the support bar or structural member without creating stresses, as encountered for example in totally welded joint constructions and in uplift restraint types of connections. The stacked embossments which have pinned connections also facilitate the fabrication of a skewed joint, or any joint for that matter, because it enables additional adjustment for alignment after the embossments are welded to their respectively associated components. In this regard, it is anticipated that the assembled embossment pairs will enable accurate mounting of the various final assembled component memmbers without templates, fixtures, rigid tolerances or alignment measurements and that such installation may therefore be more efficiently provided due to the flexibility provided by the present invention.

From the foregoing, it is apparent that the objects of the present invention have been fully accomplished. As a result of this invention, an improved mounting means is provided for supporting a structural member on an underlying support bar in a manner to resist vertical separation and relative translational displacement while being able to undergo at least limited rotational movement in a horizontal plane.

Having thus described and illustrated various embodiments of my invention, it will be understood that such description and illustration is by way of example only and that such modifications and changes as may suggest themselves to those skilled in the art are intended to fall within the scope of the present invention as limited only by the appended claims.

I claim:

1. In a composite expansion joint assembly for a bridge and the like, said assembly having a pair of edge members adapted to define the opposite sides of an expansion groove between bridge sections, said edge members having oppositely directed elongated openings extending lengthwise of said groove, laterally spaced support bars extending transversely of said groove with the opposite ends of said bars extending through said openings beyond the opposite side of said groove, a plurality of elongated resiliently yieldable sealing elements in a side-by-side relation extending longitudinally of said groove, at least one elongated rigid structural member interposed between said sealing elements and extending lengthwise thereof, said structural member being supported above and mounted to at least one of said support bars; means for mounting said structural member to said support bar, said mounting means comprising swivel connector means disposed between said structural member and said support bar for operatively restraining said structural member against any substantial vertical or translational movement relative to said support bar while allowing at least limited relative rotational movement between said support bar and said structural member about said swivel connector.

2. A composite expansion joint assembly as set forth in claim 1 wherein said mounting means comprises a pinned connection between said support bar and said structural member.

3. A composite expansion joint assembly as set forth in claim 2 wherein said mounting means further comprises at least one embossment element interposed between said support bar and said structural memmber through which said pinned connection extends.

4. A composite expansion joint assembly as set forth in claim 3 wherein said mounting means comprises two embossment elements, one of said elements being rigidly affixed to said support bar and the other of said elements being rigidly affixed to said structural member whereby said embossments are disposed one against the other for undergoing relative rotation with respect to one another.

5. The composite expansion joint assembly as set forth in claim 4 wherein said embossments include cavities therein and axially aligned bores connecting said cavities whereby said pinned connection may extend through said aligned bores and terminate within said embossment cavities.

6. A composite expansion joint assembly as set forth in claim 5 wherein said pinned connection comprises a pin type of element extending through said aligned bores of said embossments and having each of its ends formed into a rivet-like shape for reception in said embossment cavities.

7. A composite expansion joint assembly as set forth in claim 6 wherein a resilient shim is disposed between said embossments for absorbing any looseness in said joint assembly.

8. A composite expansion joint assembly as set forth in claim 5 wherein said pinned connection comprises a nut and bolt means having its ends received in said embossment cavities.

9. A composite expansion joint assembly as set forth in claim 5 wherein said pinned connection comprises a bolt means, said bolt means having a head portion on one of its ends disposed in one of said embossment cavities and a threaded portion engaged with said aligned bore of the other of said embossments.

10. A composite expansion joint assembly as set forth in claim 4 wherein one of said embossments includes a threaded stud received with the other of said embossments.

11. A composite expansion joint assembly as set forth in claim 4 wherein one of said embossments includes a stud element extending outwardly therefrom toward the other of said embossments, said other embossment having a cavity therein and a bore axially aligned with said stud element and communicating with said cavity, said axially aligned bore being adapted to receive said stud in a manner so that said stud becomes locked within said embossment cavity.

12. A composite expansion joint assembly as set forth in claim 4 wherein each of said support bars has only one structural member mounted thereon by said mounting means and each structural member is mounted to at least one support bar at each of its longitudinal end portions.

13. The composite expansion joint assembly as set forth in claim 12 wherein said embossments include cavities therein and axially aligned bores connecting said cavities whereby said pinned connection may extend through said aligned bores and terminate within said embossment cavities.

14. A composite expansion joint assembly as set forth in claim 13 wherein said pinned connection comprises a pin type of element extending through said aligned bores of said embossments and having each of its ends formed into a rivet-like shape for reception in said embossment cavities.

15. A composite expansion joint assembly as set forth in claim 14 wherein a resilient shim is disposed between said embossments for absorbing any looseness in said joint assembly.

16. A composite expansion joint assembly as set forth in claim 13 wherein said pinned connection comprises a nut and bolt means having its ends received in said embossment cavities.

17. A composite expansion joint assembly as set forth in claim 13 wherein said pinned connection comprises a bolt means, said bolt means having a head portion on one of its ends disposed in one of said embossment cavities and a threaded portion engaged with said aligned bore of the other of said embossments.

18. A composite expansion joint assembly as set forth in claim 12 wherein one of said embossments includes a threaded stud received with the other of said embossments.

19. A composite expansion joint assembly as set forth in claim 12 wherein one of said embossments includes a stud element extending outwardly therefrom toward the other said embossments, said other embossment having a cavity therein and a bore axially aligned with said stud element and communicating with said cavity, said axially aligned bore being adapted to receive said stud in a manner so that said stud becomes locked within said embossment cavity.

* * * * *